United States Patent [19]

Kim

[11] Patent Number: 4,792,451

[45] Date of Patent: Dec. 20, 1988

[54] MEDICINAL CAPSULE

[75] Inventor: Myung K. Kim, Seoul, Rep. of Korea

[73] Assignee: Su-Heung Capsule Co., Ltd., Kyungki, Rep. of Korea

[21] Appl. No.: 64,012

[22] Filed: Jun. 19, 1987

[30] Foreign Application Priority Data

Dec. 20, 1986 [KR] Rep. of Korea ..... 86-20833[U]

[51] Int. Cl.[4] ..... B65B 1/00; B65D 6/12; B65D 1/24; B65D 83/04

[52] U.S. Cl. ..... 424/453; 424/454; 53/266 R; 220/8; 220/20; 106/136; 206/528; 206/530; D28/2

[58] Field of Search ..... 424/453, 454; 53/266 R; 220/8, 20; 106/136; 206/528, 530; D28/2

[56] References Cited

U.S. PATENT DOCUMENTS 3,823,843 7/1974 Stephen et al. ..... 220/306
4,492,941 4/1984 Keith ..... 220/306

FOREIGN PATENT DOCUMENTS 2232236 1/1974 Fed. Rep. of Germany ..... 428/454

*Primary Examiner*—John E. Kittle
*Assistant Examiner*—Patrick J. Ryan
*Attorney, Agent, or Firm*—Birch, Stewart, Kolasch & Birch

[57] ABSTRACT

A medicinal capsule comprising a cap member containing a first circumferential slot formed on the outer surface of the upper portion, at least one raised member formed on the inner surface of the cap, a body member containing a second circumferential slot formed on the outer surface of the upper portion thereof for slidably locking with the first circumferential slot of the cap member during final locking, and at least one connecting member formed on the outer surface of the second circumferential slot of the body member and extending internal to the body member for slidably locking with the raised member of the cap member, the raised member and the connecting member being dimensional relative to each other so as to form a space therebetween whereby when the cap member and body member are preliminarily locked prior to final locking, the capsule is not deformed.

3 Claims, 3 Drawing Sheets

MEDICINAL CAPSULE

BACKGROUND OF THE INVENTION

The present invention relates to a medicinal capsule and more particularly, to a improved medicinal capsule having a space disposed between a connecting member of a body member and a raised member of a cap member thereof for preventing the capsule from transforming and twisting when it is preliminarily locked prior to final locking.

There are many types of medicinal capsules which are well known in art comprising a cap having a cap circumferential slot and a raised member and a body which may or may not have a body circumferential slot. However, these capsules suffer from a number of deficiencies such as, for example, since such capsules as shown in the prior art, for example as shown in FIGS. 6 and 7 comprise a cap A including a cap circumferential slot and a raised member d, and a body B having a tapered mouthpiece e, when the capsule is preliminarily locked in an atmosphere of moisture, heat, etc., the capsules can be transformed in the direction indicated by the arrows and changed in dimension as shown by the dotted lines (FIG. 7). As shown in prior art FIGS. 8, 9A and 9B, such capsules comprise a cap including a cap circumferential slot and a raised member $g_1$, and a body B including a body circumferential slot $g_2$, whereby the raised member $g_1$ is slidably locked to the body circumferential slot $g_2$ of the body B. However, when the capsule is preliminarily locked in a moist or hot atmosphere, the capsule can be readily transformed from the capsule as shown in FIG. 9A to the capsule as shown in FIG. 9B. As will be noted, the labels of the cap A and body B do not match when the capsule changes its dimension.

OBJECTS AND SUMMARY OF THE INVENTION

Accordingly, it is an object of the present invention to provide an improved medicinal capsule for easily prelocking without a change in its dimension.

Another object of the present invention is to provide an improved medicinal capsule which is structured with a connecting member disposed on a body circumferential slot of a body member for slidably locking with a raised member of a cap member, whereby a space is formed between the connecting and raised members for preventing the capsule from twisting when the cap member and body member are preliminarily locked prior to final sealing.

A further object of the present invention is to provide an improved medicinal capsule having the cap and body members in alignment so that the label printed thereon are also in alignment.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

The present invention relates to an improved medicinal capsule comprising a cap member containing a cap circumferential slot disposed on the upper portion, at least one raised member disposed on the inner surface of the cap member, a body member containing a body circumferential slot disposed on the upper portion thereof for slidably locking with the cap circumferential slot of the cap member during final locking, and at least one connecting member disposed on the outer surface of the body circumferential slot of the body member and extending internal to the body member for slidably prelocking with the raised member of the cap member, the raised member and the connecting member being dimensional relative to each other so as to form a space therebetween, whereby, when the cap member and body member are preliminarily locked prior to final locking, the capsule is not deformed.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
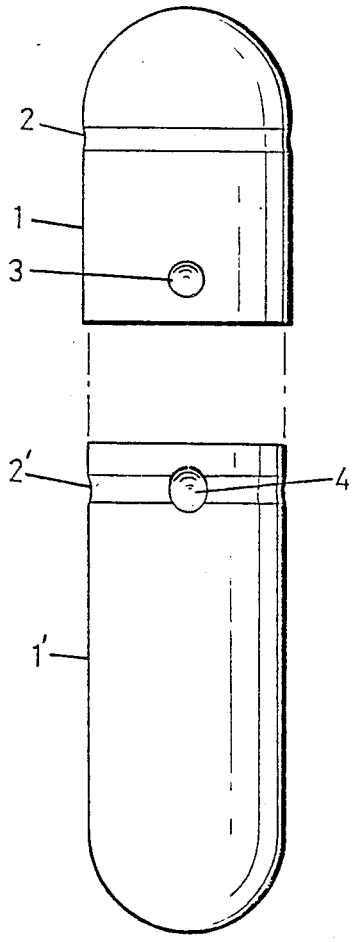
FIG. 1 is a front elevational view of the medicinal capsule of the present invention.
Figure 2:
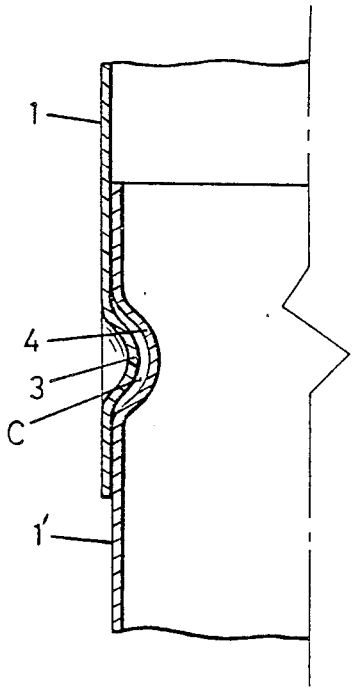
FIG. 2 is a sectional view of the prelocking of the cap member and body member of the present invention.
Figure 3:
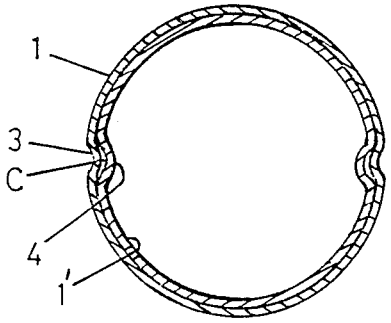
FIG. 3 is a cross-sectional view of the prelocking of the cap member and body member of the present invention.

Referring now in detail to the drawings for the purpose of illustrating the present invention, the medicinal capsule as shown in FIGS. 1, 2 and 3 comprises a cap member 1 including a cap circumferential slot 2 formed on the inner surface of the upper portion and at least one raised member 3 formed on the inner surface thereof. The capsule comprises a body member 1' including a body circumferential slot 2' formed on the outer surface of upper portion thereof for slidably engaging with the cap circumferential slot 2 and at least one connecting member 4 formed on the outer surface of the circumferential slot 2' thereof for slidably prelocking with the raised member 3 of the cap member 1 when the cap member 1 and body member 1' are preliminarily locked prior to final locking.

Figure 9A:
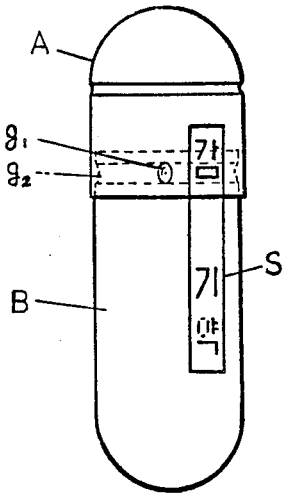
FIG. 9A is a front side elevational view of FIG. 8, showing the label in alignment.
Figure 9B:
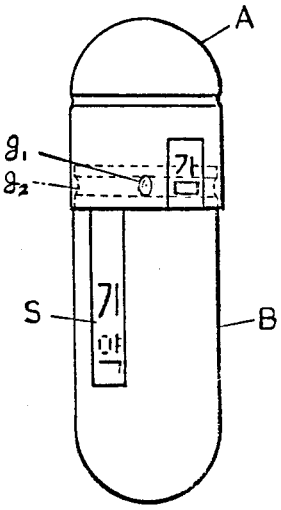
FIG. 9B is a front side elevational view of FIG. 8, showing the label out of alignment due to the transformation thereof.

In the present invention, when the cap member 1 and body member 1' are preliminarily locked before filling the medicine in the capsule e.g., "prelocking", the raised member 3 of the cap member 1 locks to the connecting member 4 of the body member 2 (FIGS. 2 and 3). At this time, a space C is formed between the connecting member 4 and the raised member 3 for preventing the raised member 3 from becoming fixed in the connecting member 4 of the body member. Therefore, the shape of the body member 1' is not transformed and not twisted, whereby the cap member 1 and body member 2 can be readily prelocked and then the capsule can be readily mass-produced by utilizing an automatic filling apparatus when the capsule is finally locked. Furthermore, since the capsule of the present invention is not transformed and not twisted during prelocking, the label S printed on the cap member 1 and body member 2 are never out of alignment with each other when compared with prior art (FIGS. 9A and 9B).

Figure 4:
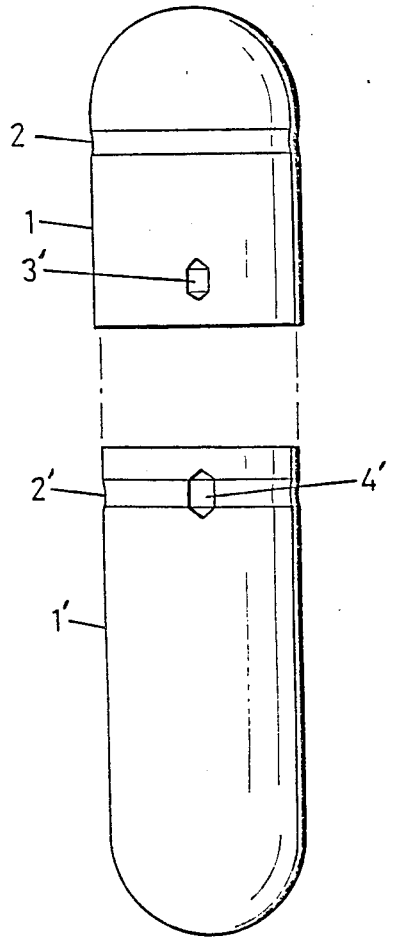
FIG. 4 is a front side elevational view of the another embodiment of the medicinal capsule of the present invention.
Figure 5:
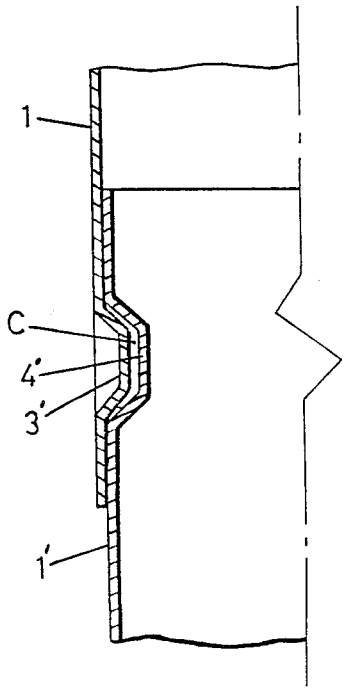
FIG. 5 is a sectional view of the prelocking of FIG. 4.
Figure 6:
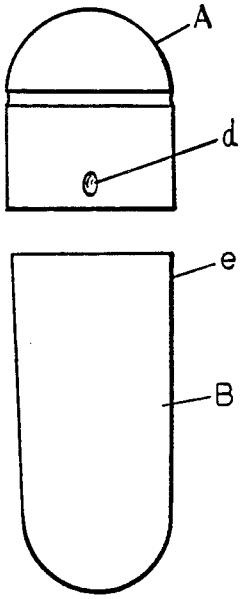
FIG. 6 is a front side elevational view of prior art of the medicinal capsule.
Figure 7:
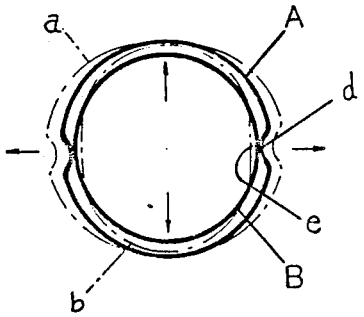
FIG. 7 is a cross-sectional view of FIG. 6.
Figure 8:
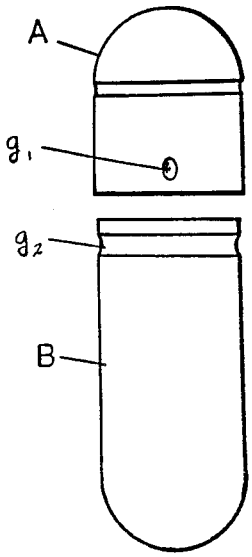
FIG. 8 is a front side elevational view of the other prior art of the medicinal capsule.

Referring in detail to FIGS. 4 and 5, there is illustrated an additional embodiment of a medicinal capsule in accordance with the present invention. The medicinal capsule as shown in FIGS. 4 and 5 comprises the cap member 1 including a cap circumferential slot 2 formed on the inner surface of the upper portion and at least one hexagon raised member 3' formed on the inner surface thereof. The body member 2 includes a body circumferential slot 2' formed on the outer surface of the upper portion thereof for slidably locking with the cap circumferential slot 2 and at least one hexagon connecting member 4' formed on the outer surface of the circumferential slot 2' thereof for slidably prelocking with the hexagon raised member 3 of the cap member 1 when the cap member 1 and body member 2 are preliminarily locked prior to final sealing.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A medicinal capsule having an inside surface and an outside surface, comprising:

a cap member containing a first circumferential slot formed on the inside surface of the upper portion thereof, at least one raised member formed on the inside surface of the lower portion of said cap member, a body member containing a second circumferential slot formed on the outside surface of the upper portion thereof for slidably locking said first circumferential slot of the cap member during final locking, and at least one connecting member formed on the outside surface of said second circumferential slot of the body member and extending internal to said body member for slidably locking with said raised member of the cap member, said connecting member having a larger radius of curvanture than the raised member of the cap for forming a space therebetween, whereby, when the cap member and body member are preliminarily locked prior to final locking, the medicinal capsule is not deformed.

2. The medicinal capsule of claim 1 wherein the raised member and the connecting member have a circular configuration, respectively, for easily interlocking with the space therebetween.

3. The medicinal capsule of claim 2 wherein the raised member and the connecting member have a hexagon configuration, respectively, for easily interlocking with the space therebetween.

* * * * *